US007033219B2

(12) United States Patent
Gordon et al.

(10) Patent No.: US 7,033,219 B2
(45) Date of Patent: Apr. 25, 2006

(54) MODULAR PLUG ASSEMBLIES, TERMINATED CABLE ASSEMBLIES AND METHODS FOR FORMING THE SAME

(75) Inventors: W. Andrew Gordon, Allen, TX (US); Darrell Bentley, Martinez, GA (US)

(73) Assignee: CommScope Solutions Properties, LLC, Sparks, NV (US)

( * ) Notice: Subject to any disclaimer, the term of this patent is extended or adjusted under 35 U.S.C. 154(b) by 0 days.

(21) Appl. No.: 11/137,152

(22) Filed: May 25, 2005

(65) Prior Publication Data

US 2005/0277340 A1 Dec. 15, 2005

Related U.S. Application Data

(60) Provisional application No. 60/578,642, filed on Jun. 10, 2004.

(51) Int. Cl.
*H01R 9/03* (2006.01)

(52) U.S. Cl. ..... 439/610

(58) Field of Classification Search ..... 439/676, 439/610, 607, 894, 425
See application file for complete search history.

(56) References Cited

U.S. PATENT DOCUMENTS

| | | | | |
|---|---|---|---|---|
| 4,767,355 | A * | 8/1988 | Phillipson et al. | 439/425 |
| 4,889,503 | A * | 12/1989 | Philippson et al. | 439/610 |
| 4,941,848 | A * | 7/1990 | Philippson et al. | 439/607 |
| 4,969,836 | A | 11/1990 | Magnier et al. | |
| 5,059,140 | A * | 10/1991 | Philippson et al. | 439/607 |
| 5,118,306 | A | 6/1992 | Bixler et al. | |
| 5,169,346 | A | 12/1992 | Johnston | |
| 5,529,506 | A | 6/1996 | Onoda | |
| 5,538,440 | A | 7/1996 | Rodrigues et al. | |
| 5,571,035 | A * | 11/1996 | Ferrill | 439/894 |
| 5,658,170 | A | 8/1997 | Tan et al. | |
| 5,906,513 | A | 5/1999 | Peterson et al. | |
| 6,464,529 | B1 * | 10/2002 | Jensen et al. | 439/405 |
| 6,722,898 | B1 | 4/2004 | Peloza et al. | |
| 2003/0060084 | A1 | 3/2003 | Aoki | |
| 2003/0228799 | A1 | 12/2003 | Machado et al. | |
| 2004/0266266 | A1 | 12/2004 | Lai | |

FOREIGN PATENT DOCUMENTS

| | | |
|---|---|---|
| DE | 41 09 863 | 10/1992 |
| EP | 1024561 A2 | 8/2000 |
| EP | 1024561 A3 | 8/2000 |

(Continued)

OTHER PUBLICATIONS

Jackson, Brian C. and Thomas W. Bleeks, "Performance characteristics of conductive coatings for EMI control", ITEM 1999.

(Continued)

*Primary Examiner*—Tulsidas C. Patel
*Assistant Examiner*—Harshad Patel
(74) *Attorney, Agent, or Firm*—Myers Bigel Sibley & Sajovec, P.A.

(57) ABSTRACT

According to embodiments of the present invention, a modular plug assembly for use with a cable including a drain wire includes a plug housing, an electrically conductive plug wrap, and an electrically conductive contact member. The electrically conductive plug wrap is mounted on the housing and includes a contact portion. The electrically conductive contact member is adapted to be mounted on the cable such that the contact member engages the drain wire. When the plug assembly is mounted on the cable, the contact member engages the contact portion of the plug wrap to provide electrical continuity between the drain wire and the plug wrap.

34 Claims, 6 Drawing Sheets

FOREIGN PATENT DOCUMENTS

| | | | |
|---|---|---|---|
| EP | 1 128 488 | | 8/2001 |
| GB | 2 243 033 | | 10/1991 |
| GB | 2 313 241 | | 11/1997 |
| JP | 2002017019 | A | 1/2002 |
| JP | 2003077593 | A | 3/2003 |
| TW | 573839 | | 1/2004 |
| WO | WO 03/034549 | A1 | 4/2003 |

OTHER PUBLICATIONS

Notification of Transmittal of the International Search Report and the Written Opinion of the International Searching Authority, or the Declaration for PCT/US2005/018712, mailed Sep. 23, 2005.

* cited by examiner

MODULAR PLUG ASSEMBLIES, TERMINATED CABLE ASSEMBLIES AND METHODS FOR FORMING THE SAME

RELATED APPLICATION(S)

This application claims the benefit of priority from U.S. Provisional Patent Application No. 60/578,642, filed Jun. 10, 2004, the disclosure of which is incorporated herein in its entirety.

FIELD OF THE INVENTION

The present invention relates to electrical connectors and, more particularly, to modular plug assemblies.

BACKGROUND OF THE INVENTION

Shielded transmission cables are commonly employed for the transmission of communications signals, for example, in structured cabling. Such cables may include one or more pairs of signal wires that are twisted along the length of the cable, a drain wire extending alongside the signal cables, a metal foil or braided sheath surrounding the twisted wire pair(s) and the drain wire, and an insulating jacket surrounding the wires and the metal foil or sheath. Typically, the signal wires are each covered by a respective insulation cover. Examples of cables of this type include foil-shielded twisted pair (FTP) cables (also commonly referred to as foil twisted pair or foil screened twisted pair cables). The shielding provided by the foil and the drain wire may serve to prevent radiation and signal loss and to reduce electromagnetic interference (EMI) and radiofrequency interference (RFI), and to meet electromagnetic frequency compatibility requirements. The drain wire directs extraneous signals to ground.

An FTP cable may be terminated by a connector, such as a plug, that is adapted to operatively engage a mating connector, such as a jack. The plug typically includes a nonconductive housing and a surrounding metal wrap. The drain wire of the cable is secured to the metal wrap, commonly by soldering or winding the drain wire about a post or other feature of the shield. When the plug is engaged with a mating shielded jack, the metal wrap of the plug contacts a corresponding metal wrap surrounding the jack so as to provide electrical continuity with a cable shield (e.g., foil shield) or other component connected to the wrap of the jack. The metal wrap of the plug may also serve as a continuation of the foil so that continuity of shielding is provided to and through the connection. The metal wrap of the plug may also be grounded via the metal wrap of the jack and a further grounded component to which the jack wrap is in contact, such as a patch panel.

SUMMARY OF THE INVENTION

According to embodiments of the present invention, a modular plug assembly for use with a cable including a drain wire includes a plug housing, an electrically conductive plug wrap, and an electrically conductive contact member. The electrically conductive plug wrap is mounted on the plug housing and includes a contact portion. The electrically conductive contact member is adapted to be mounted on the cable such that the contact member engages the drain wire. When the plug assembly is mounted on the cable, the contact member engages the contact portion of the plug wrap to provide electrical continuity between the drain wire and the plug wrap.

According to further embodiments of the present invention, a terminated cable assembly includes a cable and a modular plug assembly. The cable includes a drain wire. The modular plug assembly is mounted on the cable and includes a plug housing, an electrically conductive plug wrap, and an electrically conductive contact member. The electrically conductive plug wrap is mounted on the plug housing and includes a contact portion. The electrically conductive contact member is mounted on the cable such that the contact member engages the drain wire. The contact member engages the contact portion of the plug wrap to provide electrical continuity between the drain wire and the plug wrap.

According to method embodiments of the present invention, a method for forming a terminated cable assembly includes: mounting a plug wrap on a housing; mounting a contact member on a cable including a drain wire such that the contact member engages the drain wire; and forming a modular plug assembly on the cable, including mounting the plug housing on the cable such that the contact member engages the contact portion of the plug wrap to provide electrical continuity between the drain wire and the plug wrap.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
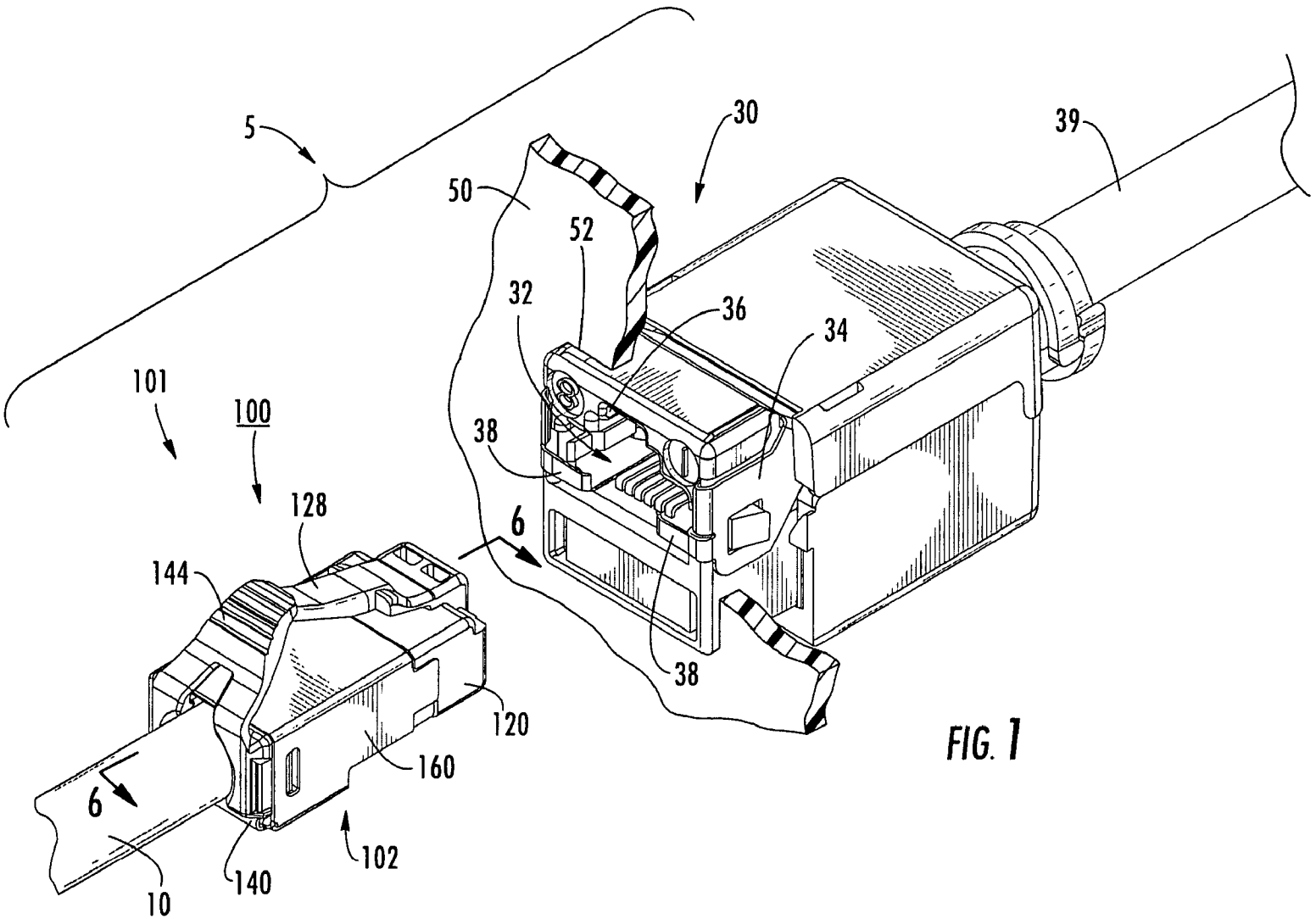
FIG. 1 is a front, perspective view of a connector system according to embodiments of the present invention, wherein a plug assembly and a jack of the connector system are shown in an uncoupled position and the jack is installed in a mount panel.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, the term "drain wire" means an uninsulated wire in a cable that is in contact with a shield of the cable, such as a metal foil or braided tube, throughout a major portion of its length.

Figure 2:
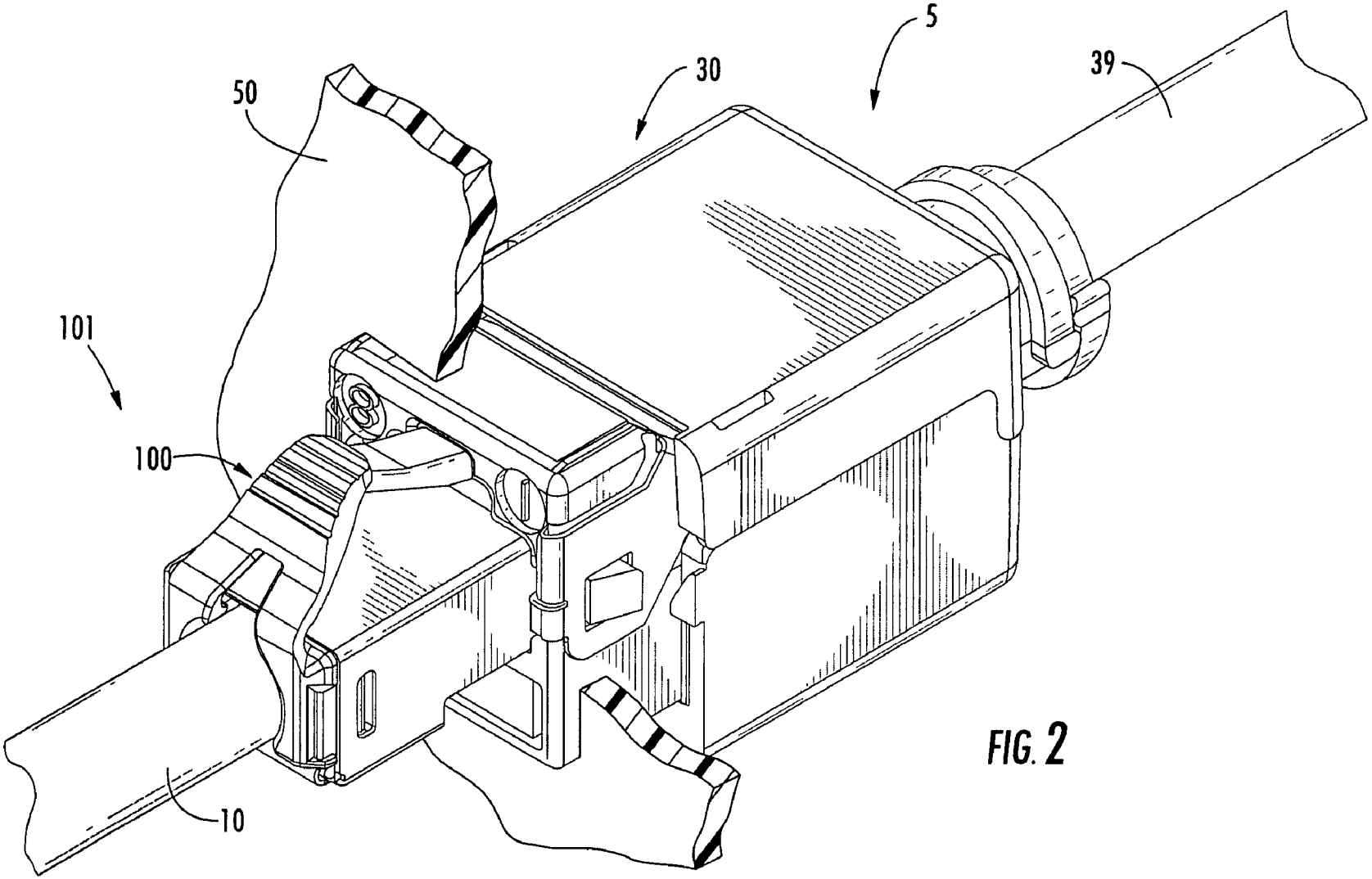
FIG. 2 is a front, perspective view of the connector system of FIG. 1, wherein the plug assembly and the jack are shown in a coupled position.

With reference to FIGS. 1–6, a shielded modular plug assembly 100 according to embodiments of the present invention is shown therein. The plug assembly 100 may be operatively connected and mounted on a cable 10 (e.g., an FTP cable) to form a terminated cable 101. The plug assembly 100 is adapted to operatively receive and couple with a modular jack 30 (FIGS. 1 and 2) associated with a cable 39 (as shown in FIG. 2) to provide continuity between the cables 10 and 39 for transmitting signals, etc. therebetween in a known manner. As discussed in more detail below, the plug assembly 100 provides EMI/RFI shielding between the interconnected cables 10, 39. The plug assembly 100 also provides continuity between a drain wire 14 of the cable 10 and a drain wire of the cable 39 and/or a mount panel 50 (e.g., a patch panel; FIGS. 1 and 2) or the like. The jack 30 may also be shielded. The plug assembly 100 and the jack 30 may together form a connector system 5 (FIGS. 1 and 2) that may be employed to make connections in structured cabling, for example. The jack 30 may be mounted in an opening 52 of the mount panel 50.

The jack 30 may be a jack assembly constructed as disclosed in Applicants' U.S. Provisional Patent Application Ser. No. 60/578,730, filed Jun. 10, 2004, and as disclosed in Applicants' U.S. patent application Ser. No. 11/137,063, filed concurrently herewith, the disclosures of which are hereby incorporated herein by reference in their entireties.

Figure 6:
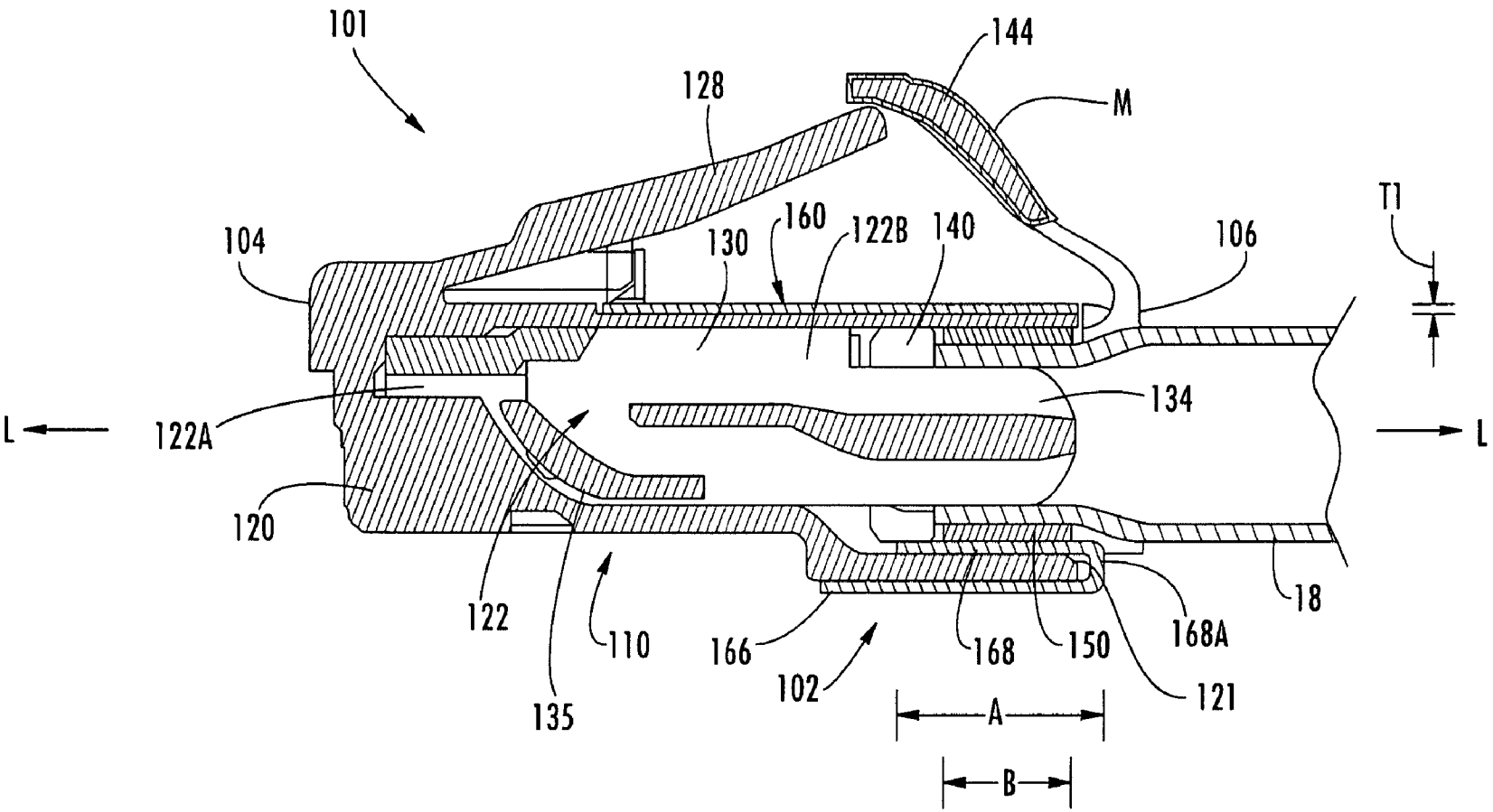
FIG. 6 is a cross-sectional view of the terminated cable of FIG. 3 taken along the line 6—6 of FIG. 1.

The plug assembly 100 has a front end 104 and a rear end 106 (FIG. 6). The plug assembly 100 includes a housing assembly 110, electrical contacts 108 (FIG. 7), a contact member or retainer ring 150, and a plug wrap 160. The housing assembly 110 includes a front housing 120, a sled or carrier 130, a carrier cap 135, and a rear housing 140. The plug wrap 160 extends around a portion of the housing assembly 110 and defines an EMI/RFI shield 102 (FIG. 1). The retainer ring 150 and the plug wrap 160 are separately formed.

Turning to the front housing 120 in more detail, the front housing 120 defines an interior cavity 122 (FIGS. 5 and 6) and a rear opening 121 communicating with the cavity 122. The cavity 122 includes a front cavity portion 122A and a relatively larger rear cavity portion 122B. Contact slots 124 (FIGS. 3 and 4) are defined in the front end of the front housing 120 and communicate with the front cavity portion 122A. A pair of latch apertures 126A are formed in opposed sides of the front housing 120 adjacent the rear end thereof. Rear tabs 126B extend rearwardly from the rear end. A latch lever 128 having latch extensions 128A extends from the top of the front housing 120. The latch extensions 128A are adapted to engage complementary latch features 36 of the jack 30 to releasably secure the plug assembly 100 in the socket 32 in a known manner, for example.

Figure 4:
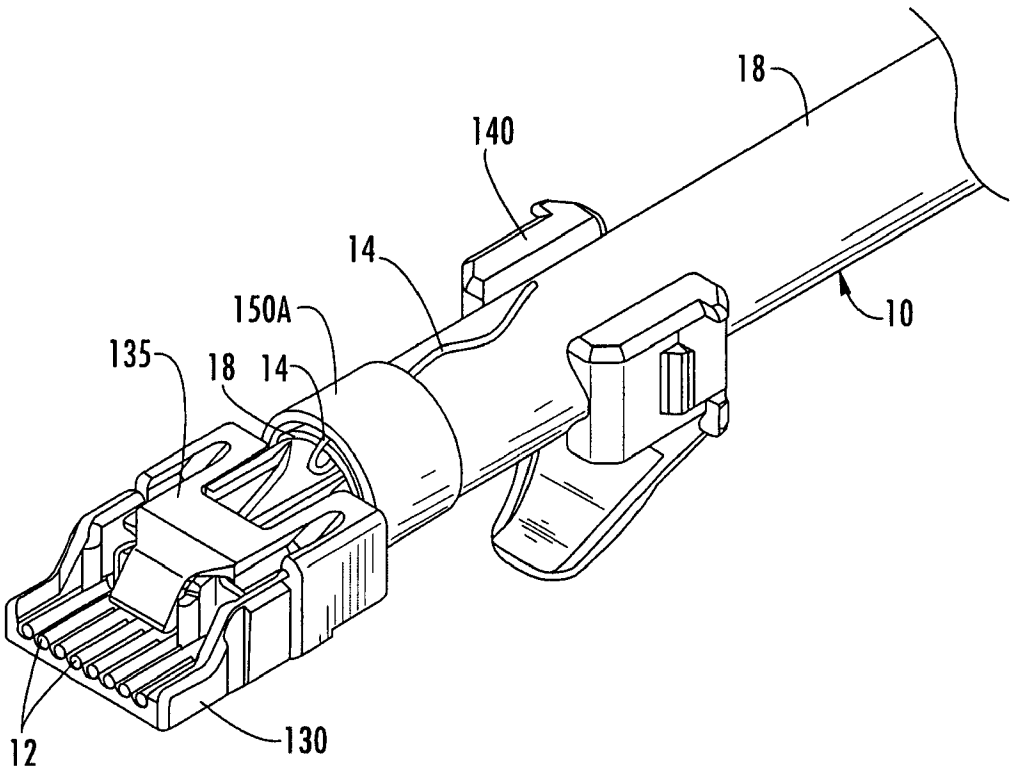
FIG. 4 is a front, bottom, perspective view of the terminated cable of FIG. 3 wherein the terminated cable is partially assembled and a retainer ring thereof is not yet crimped.
Figure 4:
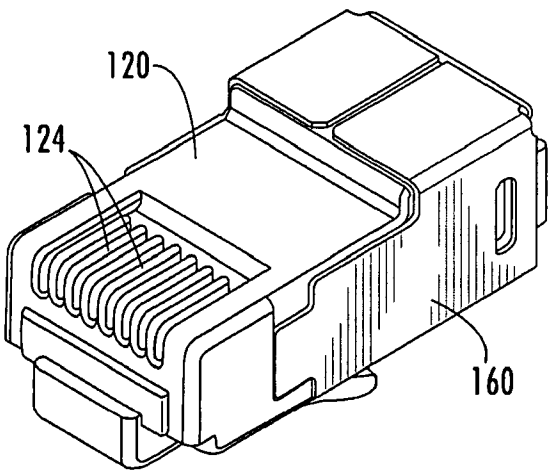

The carrier 130 includes a body 132 and a semi-tubular extension 134 of reduced width extending rearwardly from the body 132. The extension 134 is sized and configured to be inserted into a jacket 18 of the cable 10. Wire pair dividers 136 extend radially inwardly from the body 132 and the extension 134 and define a plurality of wire slots. The carrier cap 135 is adapted to snap lock onto the carrier 130 as shown in FIG. 4.

The rear housing 140 includes a longitudinal passage adapted to receive the cable 10. A resilient anti-snag lever 144 extends upwardly from the rear housing 140. A pair of latch tabs 146A and two pairs of stop tabs 146B extend laterally outwardly from opposed sides of the rear housing 140.

The front housing 120, the carrier 130, the carrier cap 135, and the rear housing 140 may be formed of any suitable dielectric or electrically insulating or non-conductive material. Suitable materials include polymeric or plastic materials such as polycarbonate (PC), ABS and/or PC/ABS blend. The front housing 120, the carrier 130, the carrier cap 135, and the rear housing 140 may be molded. According to some embodiments, each of the front housing 120, the carrier 130, the carrier cap 135, and the rear housing 140 comprises an integral and unitary piece.

Figure 3:
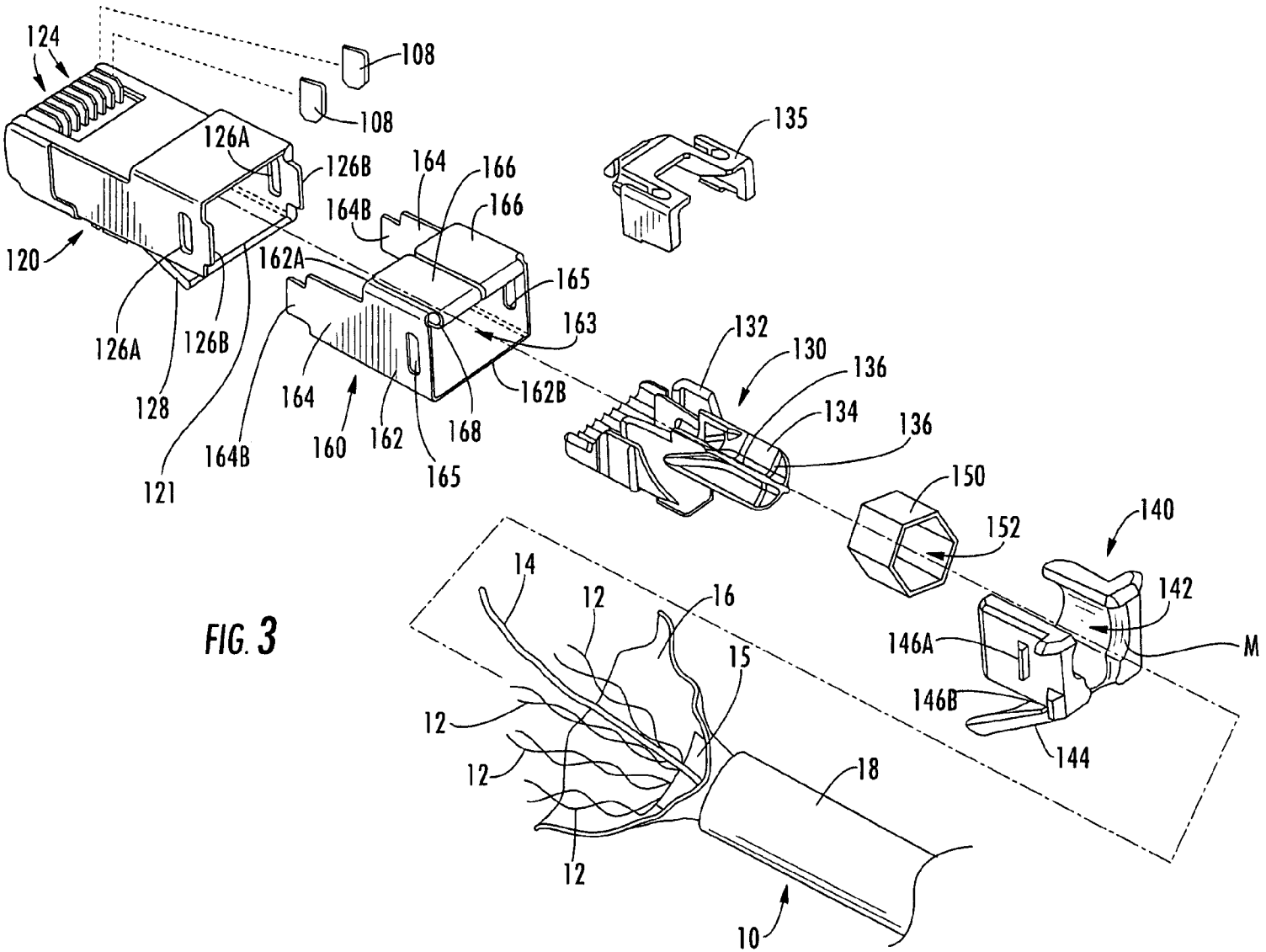
FIG. 3 is an exploded, bottom, rear perspective view of a terminated cable forming a part of the connector system of FIG. 1.

The electrical contacts 108 (only two are shown in FIG. 3) are configured and positioned in the contact slots 124 of the front housing 120 to engage respective corresponding wires 12 of the cable 10, and also to engage respective corresponding contacts of the jack 30 when the plug 100 is mated to the jack 30. The electrical contacts 108 may be blade-shaped as shown. The electrical contacts 108 may be formed of any suitable electrically conductive material.

According to some embodiments, the electrical contacts 108 are formed of a metal such as copper. The electrical contacts 108 may be formed by any suitable method, such as stamping from a metal sheet.

The retainer ring 150 is an endless ring and defines a through passage 152 (FIG. 3). The retainer ring 150 is shown in a non-crimped condition (referenced as component 150A) in FIG. 4 and in a crimped condition in FIGS. 3, 5 and 6. The retainer ring 150 may be formed of any suitable electrically conductive material. According to some embodiments, the retainer ring 150 is formed of a metal such as steel. The retainer ring 150 may be formed by any suitable method, such as stamping from a metal sheet and rolling, rolling from a metal sheet and cutting, or extruding a metal tube and cutting. As formed, the retainer ring 150 is malleable to allow crimping. According to some embodiments, the retainer ring 150 is unitarily formed.

With reference to FIG. 3, the plug wrap 160 includes a generally tubular body 162 defining a through passage 163 and having a pair of side by side top walls 166, a front tubular edge 162A and a rear tubular edge 162B. A pair of opposed side walls 164 extend forwardly from the body 162. A pair of opposed extension tabs 164B extend forwardly from the side walls 164. A pair of opposed latch apertures are formed adjacent the rear end of the body 162. A pair of contact tabs 168 are joined to the top walls 166 by folds or bends 168A and are disposed in the passage 163.

The plug wrap 160 may be formed of any suitable electrically conductive material. According to some embodiments, the plug wrap 160 is formed of a metal such as steel. The plug wrap 160 may be formed by any suitable method, such as stamping from a metal sheet. According to some embodiments, the plug wrap 160 is unitarily formed.

According to some embodiments, the nominal thickness T1 (FIG. 6) of the plug wrap 160 is between about 0.008 and 0.012 inch. According to some embodiments, the length A (FIG. 6) of the tabs 168 is at least about 0.1 inch and, according to some embodiments, between about 0.23 and 0.25 inch.

The construction of the plug assembly 100 and the cable assembly 101 may be better appreciated from the description below of methods for assembling the plug assembly 100 and the cable assembly 101. In accordance with embodiments of the invention, the plug assembly 100 can be assembled and mounted on the cable 10 in the following manner. The cable 10 may be any suitable type of cable. As shown in FIG. 3, the cable 10 includes the jacket 18, the drain wire 14, a tubular shield sleeve 16, a plastic film tube 15, and a plurality of twisted pairs of conductor members 12 (for clarity, the plastic film tube 15, the tubular shield sleeve 16, and the conductor members 12 are not shown in FIG. 6). The shield sleeve 16 as illustrated is a metal foil shield (e.g., a metal foil laminated to a plastic film backing); however, the shield sleeve 16 could be a braided metal shield tube or the like. The conductor members 12 may each include an electrical conductor surrounded by a respective layer of insulation. It will be appreciated that other types of cables may be employed.

Figure 5:
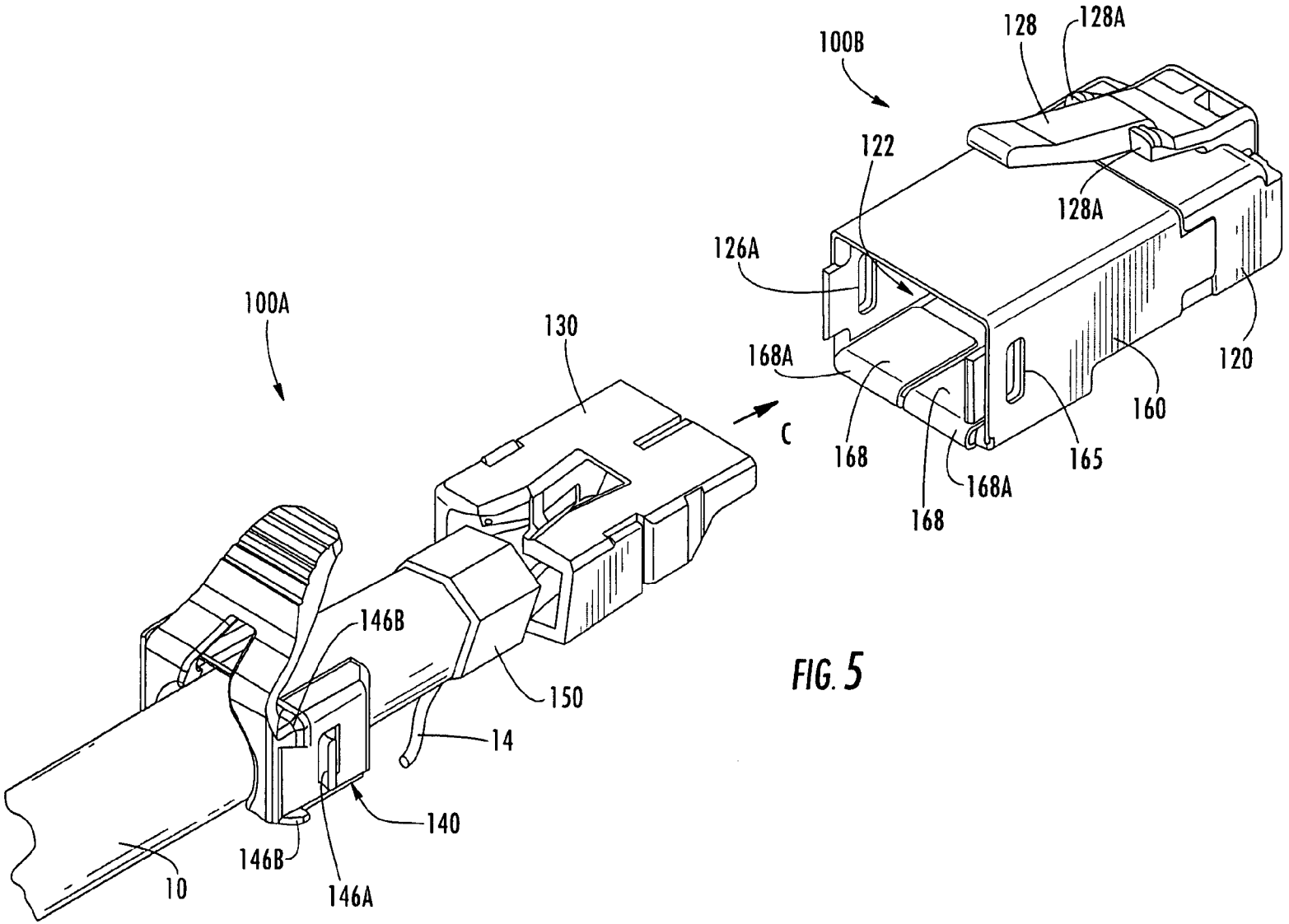
FIG. 5 is a rear, top, perspective view of the terminated cable of FIG. 4 wherein the terminated cable is partially assembled and a retainer ring thereof has been crimped about a cable.

The plug assembly 100 may be formed by first forming first subassembly 100A and second subassembly 100B and, thereafter, joining the first and second subassemblies 100A, 100B. In order to form the first subassembly 100A (FIG. 5), the jacket 18, the foil 16 and the film 15 of the cable 10 are trimmed (e.g., using a ring cutter) so that the conductor members 12 and the drain wire 14 are exposed. The drain wire is 14 folded back generally 180 degrees to lie along the length of the cable 10 as shown in FIG. 4. The non-crimped retainer ring 150A is slid over the cable 10. The extension 134 of the carrier 130 is inserted into the jacket 18. The retainer ring 150A is slid over the drain wire 14 and jacket 18 such that the jacket 18 is interposed or sandwiched between the retainer ring 150A and the extension 134 adjacent the end of the cable 10, and the drain wire 14 is interposed or sandwiched between the retainer ring 150A and the jacket 18 (as well as the extension 134). The retainer ring 150A is then crimped to form the crimped retainer ring 150 as shown in FIG. 5. In this manner, the carrier 130 is mechanically secured to the cable 10 and the drain wire 14 is positively and securely engaged by the retainer ring 150. The wires 12 are then laid into the wire slots of the carrier 130 and secured in place by mounting the carrier cap 135 on the carrier 130 as shown in FIG. 4. (For purposes of illustration, the carrier cap 135 is shown mounted on the carrier 130 while the retainer ring 150A is crimped; however, it may be preferable to crimp the retainer ring 150A before mounting the carrier cap 135 as discussed because the crimping procedure may reorient the wires.) The wires 12 may be trimmed as needed.

In order to form the second subassembly 100B (FIG. 5), the plug wrap 160 is slid onto the front housing 120 as shown in FIGS. 4 and 5. The plug wrap 160 is positioned such that the latch apertures 126A and 165 align (FIG. 5) and the tabs 168 are located in the passage 122 of the front housing 120. The tabs 168 may be bent into the folded position before installing the plug wrap 160 on the front housing 120 (e.g., the tabs 168 may be pre-bent by the manufacturer). Alternatively, or additionally, the plug wrap 160 can be mounted on the front housing 120 and the tabs 168 thereafter bent into the passage 122. According to some embodiments, the side walls 164 and/or the body 162 are configured to form a moderate interference fit with the front housing in order to retain the plug wrap 160 on the front housing 120. Other features may be provided to temporarily or permanently secure the plug wrap 160 to the front housing 120.

The first and second subassemblies 100A, 100B are then joined by inserting a portion of the first subassembly 100A into the passage 122 of the front housing 120 in a direction C (FIG. 5) along the longitudinal axis L-L. According to some embodiments and as shown, the first subassembly 100A is inserted into the passage 122 up to or beyond the rear or trailing end of the retainer ring 150. When the subassemblies 100A, 100B are finally positioned, the retainer ring 150 and the tabs 168 overlap along the longitudinal axis L-L. The retainer ring 150 engages the contact tabs 168 to provide electrical continuity between the retainer ring 150 and the contact tabs 168. According to some embodiments, the retainer ring 150 and the contact tabs 168 form an interference fit to ensure that the engagement is maintained.

According to some embodiments, the retainer ring 150 and the contact tabs 168 overlap a distance B (FIG. 6) of at least 0.1 inch. According to some embodiments, the distance B is between about 0.22 and 0.26 inch.

The rear housing 140 is placed over the jacket 18 and slid into the passage 122 until the latches 146A interlock with the apertures 126A, 165. The stop tabs 146B prevent over-insertion of the rear housing 140. The rear tabs 126B are received between the stop tabs 146B and positively locate the rear housing 140 above the tabs 168 so that the rear housing 140 does not undesirably displaced the tabs 168.

The contacts 108 may thereafter by inserted through the slots 124 to engage respective ones of the conductors of the wires 12. A crimping tool or the like may be used to install the contacts 108.

The assembled plug assembly 100 can thereafter be inserted into the socket 32 of the jack 30 until the latch extensions 128A interlock with the latch features 36 of the jack 30. When the plug assembly 100 is so inserted, the contacts 108 operatively electrically engage the contacts of the jack 30 and the side walls 164 engage contact tabs 38 in the socket 32 of the jack 30. The contact tabs 38 may form part of a jack wrap or a jumper member or clip 34, for example, which is electrically coupled to the drain wire of the cable 39. The tabs 38 may be spring biased to ensure positive and adequate contact between the tabs 38 and the plug wrap 160. In this manner, the connector system 5 provides electrical continuity between the respective drain wires of the cables 10 and 39, either or both of which may lead to ground. The jack wrap 34 may also provide electrical continuity with a metallization layer or other grounding structure of the mount panel 50.

In addition to providing drain wire continuity, the plug assembly 100 may provide EMI/RFI shielding. The plug wrap body 162 provides a substantially continuous tubular shield 102 that extends from the edge 162A to the edge 162B along the longitudinal axis L-L (FIG. 6). That is, substantially 360 degrees of shielding is provided from the edge 162A to the edge 162B. According to some embodiments, the shield 102 extending from the edge 162A to the edge 162B is at least about 80% complete (i.e., free of openings). According to some embodiments, the shield 102 is at least about 95% complete. The foil 16 of the cable 10 overlaps with the body 162 between the edges 162A, 162B so that the tubular shield of the foil 16 is effectively extended to the front edge 162A. When the plug assembly 160 is fully coupled with the jack 30, the shield 102 overlaps with the shield of the jack 30 so that the connection is shielded along its full length. As discussed above, the retainer ring 150 and the tabs 168 may form an interference fit. According to some embodiments, an interference of at least about 0.005 inch is provided.

According to some embodiments, the contact tabs 168 are configured such that they tend to stand off from the adjacent interior surface of the front housing 120 when unloaded, so that the contact tabs 168 are spring biased against the retainer ring 150 when the plug assembly 100 is fully assembled.

The plug wrap 160 may be constructed to meet conventionally required or desired drain wire continuity standards. According to some embodiments, the plug wrap 160 introduces a resistance of no more than about 20 milliohms from the drain wire 14 to the contact tabs 164B. According to some embodiments, the plug wrap 160 and the jack wrap 34 in combination introduce a resistance of no more than about 40 milliohms from the drain wire 14 to the drain wire of the cable 39.

The plug assembly 100 may comprise a modular plug that complies with applicable standards. The plug assembly 100, the terminated cable 101 and the connector system 5 of the present invention may be particularly suitable for use in high speed data transmission lines, for example, of the type including shielded twisted wire pairs (e.g., FTP cables). However, the plug assemblies, terminated cables and connector systems of the present invention may be used for other types of cables as well. The plug assembly 100 may be a RJ-type plug. According to some embodiments, the plug assembly 100 is an RJ45 plug adapted to operatively mate with an RJ45 jack socket. According to some embodiments, the plug assembly 100 complies with the standards of at least one of the following: the International Electrotechnical Commission (IEC), the Telecommunications Industry Association (TIA), and the Electronic Industries Alliance (EIA). According to some embodiments, the plug assembly 100 complies with at least one of the foregoing standards as applicable for RJ45 plugs.

Plug assemblies according to the present invention such as the plug assembly 100 may provide a number of advantages. The plug assembly 100 provides a reliable electrical path from the drain wire to the contacts 164B without requiring a direct termination of the drain wire to the plug wrap by soldering or the like. The plug assembly 100 further provides EMI/RFI shielding. According to some embodiments, the plug assembly 100 achieves 10 volt/meter radiated field per IEC Standard 61000- 4-3 and 10 volt/meter conducted field per IEC Standard 61000-4-6. The plug assembly 100 provides for ease of assembly and may be retrofitted to non-shielded plug housings. The retainer ring 150 serves to both provide electrical continuity and mechanically secure the carrier 130 to the cable 10.

In accordance with further embodiments of the invention, various modifications may be made to the foregoing methods and devices and various features or aspects thereof may be employed without the other(s). For example, the crimped retainer ring 150 may be differently shaped or replaced or supplemented with an electrically conductive contact member of a different type or configuration. It will be appreciated from the description herein that the order of certain of the steps for assembling the plug assembly and forming the terminated cable may be altered.

Optionally and as illustrated, the rear housing 140 may be metallized such that it is fully or partially surrounded by a metallization layer M (FIG. 6). The metallization layer M of the rear housing 140 engages the contact tabs 168 and/or the retainer ring 150 to provide electrical continuity with the drain wire 14. The metallization layer M thereby forms a part of the EMI/RFI shield 102. More particularly, the metallization layer M of the rear housing 140 provides EMI/RFI shielding for the rear opening 121 of the front housing 120.

The metallization layer M may be applied to the rear housing 140 by any suitable means. The metallization layer M may cover only the outer surfaces of the rear housing 140, only the inner surfaces of the rear housing 140, or both the inner and outer surfaces. The metallization layer M may be bonded to the surface of the rear housing 140. The metallization layer M may be formed of any suitable material such as stainless steel, gold, nickel-plated copper, silver, silvered copper, nickel, nickel silver, copper or aluminum. The metallization layer M may be formed and applied by any suitable techniques. Suitable techniques may include electroless coating, electroplated coating, conductive paint, and/or vacuum metallizing. According to some embodiments, the metallization layer M is a layer of nickel-plated copper applied using electroless plating.

According to some embodiments, the metallization layer M has a thickness of no more than about 240 micro inches. According to some embodiments, the thickness of the metallization layer is between about 20 and 240 micro inches. According to some embodiments, the thickness of the metallization layer is between about 40 and 120 micro inches. Additionally or alternatively, other portions of the housing assembly 110 may be metallized.

A metallized rear housing (e.g., the metallized rear housing 140) as discussed above may be used in plug assemblies of other configurations, as well. For example, a plug assembly may include a front housing (e.g., the housing 120) and the metallized rear housing 140, but omit the plug wrap 160. Shielding about the plug front housing 120 may be provided by a foil or other suitable means, and the drain wire 14 may be soldered or otherwise electrically coupled to the foil etc. When the plug assembly is assembled, the metallized rear housing 140 is electrically grounded (e.g., by engaging the foil) and provides EMI/RFI shielding for the rear opening 121 of the front housing 120.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A modular plug assembly for use with a cable including a drain wire, the plug assembly comprising:

a) a plug housing defining an interior cavity;

b) an electrically conductive plug wrap mounted on the plug housing, the plug wrap including an outer portion surrounding at least a portion of the plug housing and a contact portion disposed in the interior cavity; and c) an electrically conductive contact member adapted to be mounted on the cable such that the contact member engages the drain wire;

d) wherein, when the plug assembly is mounted on the cable, the contact member is received in the interior cavity such that the contact member engages the contact portion of the plug wrap within the interior cavity to provide electrical continuity between the drain wire and the plug wrap.

2. The plug assembly of claim 1 wherein, when the plug assembly is mounted on the cable, the contact member and the contact portion of the plug wrap form an interference fit therebetween in the interior cavity.

3. The plug assembly of claim 1 wherein the contact member includes a ring adapted to surround the cable.

4. The plug assembly of claim 3 wherein the contact member includes a crimp ring.

5. The plug assembly of claim 1 including an inner housing adapted to receive at least one electrical conductor member of the cable, wherein at least a portion of the inner housing is received in the interior cavity when the plug assembly is mounted on the cable.

6. The plug assembly of claim 1 wherein the plug wrap and the contact member are separately formed.

7. The plug assembly of claim 1 wherein the plug wrap includes a second contact portion adapted to engage a contact portion of a jack when the modular plug assembly is inserted into the jack.

8. The plug assembly of claim 1 wherein the plug wrap includes a shield body surrounding at least a portion of the plug housing and adapted to attenuate EMI and/or RFI.

9. The plug assembly of claim 1 wherein the plug wrap is unitarily formed.

10. The plug assembly of claim 1 wherein the plug housing is formed of a dielectric material.

11. The plug assembly of claim 1 wherein at least a portion of the plug housing is metallized.

12. The plug assembly of claim 11 wherein:

a) the plug housing includes a front housing and a rear housing;

b) the front housing defines an interior cavity and a rear opening;

c) the rear housing includes an electrically non-conductive substrate metallized with a metal shield layer; and d) the rear housing is positionable about the cable to provide EMI/RFI shielding for the rear opening of the front housing.

13. The plug assembly of claim 1 wherein the plug assembly is an RJ-45 modular plug.

14. The plug assembly of claim 1 wherein:

a) the plug wrap is unitarily formed and includes:

a second contact portion adapted to engage a contact portion of a jack when the modular plug assembly is inserted into the jack; and a shield body surrounding at least a portion of the plug housing and adapted to attenuate EMI and/or RFI;

b) the contact member includes a crimp ring adapted to surround the cable;

c) the contact member forms an interference fit with the contact portion within the interior cavity when the plug assembly is mounted on the cable; and d) the plug assembly further includes an inner housing adapted to receive at least one electrical conductor member of the cable, wherein at least a portion of the inner housing is received in the interior cavity when the plug assembly is mounted on the cable.

15. The plug assembly of claim 14 wherein the plug wrap and the contact member are separately formed.

16. A terminated cable assembly comprising:

a) a cable including a drain wire; and b) a modular plug assembly mounted on the cable and including:

a plug housing defining an interior cavity;

an electrically conductive plug wrap mounted on the plug housing, the plug wrap including an outer portion surrounding at least a portion of the plug housing and a contact portion disposed in the interior cavity; and an electrically conductive contact member mounted on the cable such that the contact member engages the drain wire; and wherein the contact member the contact member is received in the interior cavity such that the contact member engages the contact portion of the plug wrap within the interior cavity to provide electrical continuity between the drain wire and the plug wrap.

17. The cable assembly of claim 16 wherein:

a) the plug wrap is unitarily formed and includes:

a second contact portion adapted to engage a contact portion of a jack when the modular plug assembly is inserted into the jack; and a shield body surrounding at least a portion of the plug housing and adapted to attenuate EMI and/or RFI;

b) the contact member includes a crimp ring surrounding and crimped about the cable;

c) the contact member forms an interference fit with the contact portion within the interior cavity; and d) the plug assembly includes an inner housing, at least a portion of which is received in the interior cavity;

e) the cable includes at least one electrical conductor member, at least a portion of which is mounted on the inner housing; and f) the plug wrap and the contact member are separately formed.

18. A method for forming a terminated cable assembly, the method comprising:

a) mounting a plug wrap on a plug housing defining an interior cavity;

b) mounting a contact member on a cable including a drain wire such that the contact member engages the drain wire; and c) forming a modular plug assembly on the cable, including mounting the plug housing on the cable such that the contact member is inserted into the interior cavity and engages the contact portion of the plug wrap within the interior cavity to provide electrical continuity between the drain wire and the plug wrap.

19. The method of claim 18 wherein the steps of mounting the plug wrap on the plug housing and mounting the contact member on the cable precede the step of mounting the plug housing on the cable.

20. The method of claim 18 including forming an interference fit between the contact member and the contact portion of the plug wrap within the interior cavity.

21. The method of claim 18 wherein the contact member includes a ring adapted to surround the cable and mounting the contact member on the cable includes crimping the ring about the cable and onto the drain wire.

22. The method of claim 18 including:

mounting at least one electrical conductor member of the cable in an inner housing of the plug assembly; and thereafter inserting at least a portion of the inner housing into the interior cavity.

23. The method of claim 18 wherein the plug wrap includes a second contact portion adapted to engage a contact portion of a jack when the modular plug assembly is inserted into the jack.

24. The method of claim 18 including surrounding at least a portion of the plug housing with a shield body of the plug wrap, wherein the shield body is adapted to attenuate EMI and/or RFI.

25. The method of claim 18 wherein at least a portion of the plug housing is metallized.

26. The method of claim 18 wherein the plug assembly is an RJ-45 modular plug.

27. The plug assembly of claim 1 wherein the contact portion includes a contact tab disposed in the interior cavity and connected to the outer portion of the plug wrap by a bend.

28. The plug assembly of claim 27 wherein, when the plug assembly is mounted on the cable, the contact tab is spring biased against the contact member within the interior cavity.

29. The cable assembly of claim 16 wherein the contact portion includes a contact tab disposed in the interior cavity and connected to the outer portion of the plug wrap by a bend.

30. The cable assembly of claim 29 wherein the contact tab is spring biased against the contact member within the interior cavity.

31. The method of claim 18 wherein the contact portion includes a contact tab disposed in the interior cavity and connected to the outer portion of the plug wrap by a bend, and including spring biasing the contact tab against the contact member within the interior cavity.

32. A modular plug assembly for use with a cable including a drain wire, the plug assembly comprising:

a) a plug housing;

b) an electrically conductive plug wrap mounted on the plug housing and including a contact portion; and c) an electrically conductive contact member adapted to be mounted on the cable such that the contact member engages the drain wire;

d) wherein, when the plug assembly is mounted on the cable, the contact member engages the contact portion of the plug wrap to provide electrical continuity between the drain wire and the plug wrap; and e) wherein at least a portion of the plug housing is metallized.

33. The plug assembly of claim 32 wherein:

a) the plug housing includes a front housing and a rear housing;

b) the front housing defines an interior cavity and a rear opening;

c) the rear housing includes an electrically non-conductive substrate metallized with a metal shield layer; and d) the rear housing is positionable about the cable to provide EMI/RFI shielding for the rear opening of the front housing.

34. The plug assembly of claim 32 wherein the plug housing includes an electrically non-conductive substrate with a metal shield layer bonded thereto.

* * * * *